United States Patent [19]

Ruemer, Jr.

[11] 4,387,827

[45] Jun. 14, 1983

[54] CONTAINER CLOSURE

[75] Inventor: John Ruemer, Jr., Baltimore, Md.

[73] Assignee: Crown Cork & Seal Company, Incorporated, Philadelphia, Pa.

[21] Appl. No.: 325,462

[22] Filed: Nov. 27, 1981

[51] Int. Cl.[3] ..... B65D 17/34

[52] U.S. Cl. ..... 220/269

[58] Field of Search ..... 220/266–273

[56] References Cited

U.S. PATENT DOCUMENTS

| | | | |
|---|---|---|---|
| 3,744,666 | 7/1973 | Heffner | 220/269 |
| 3,749,275 | 7/1973 | Smith, Jr. et al. | 220/269 |
| 3,795,342 | 3/1974 | Ashton | 220/269 |
| 3,799,390 | 3/1974 | Cudzik | 220/269 |
| 3,836,038 | 9/1974 | Cudzik | 220/269 |
| 3,843,011 | 10/1974 | Perry | 220/269 |
| 3,877,606 | 4/1975 | Silver | 220/269 |
| 3,967,750 | 7/1976 | Cudzik | 220/266 |
| 3,967,752 | 7/1976 | Cudzik | 220/269 |
| 3,967,753 | 7/1976 | Cudzik | 220/269 |
| 4,320,850 | 3/1982 | Drolen, Jr. | 220/269 |

*Primary Examiner*—George T. Hall

*Attorney, Agent, or Firm*—Woodcock, Washburn, Kurtz, Mackiewicz & Norris

[57] ABSTRACT

An improved easy opening container end is disclosed of the type wherein an opening tab is attached to a wall of a can end closure at a fulcrum adjacent a primary score line. The primary score line circumscribes a pore opening panel except at a hinge area. The forward portion of the opening tab is adapted to depress the pore opening panel into the container to expose a pore opening when the opening tab is pivoted about the fulcrum. The opening tab is attached to the wall by means of a rivet. One secondary score line contiguous with the primary score line projects away from the pore opening panel on one side of the rivet and another secondary score line, also contiguous with the primary score line, projects away from the pore opening panel on the other side of the rivet. In this manner, after the primary score line is severed and the pore opening panel is depressed, the opening tab may be retracted from the vicinity of the pore opening panel by severing the secondary score line so as to permit easy removal of the contents of the container and to expose an underportion of the wall for the reading of promotional indicia.

5 Claims, 4 Drawing Figures

CONTAINER CLOSURE

BACKGROUND OF THE INVENTION

The present invention relates in general, to a container closure and, in particular, relates to a container closure having an opening tab adapted to be retained thereto after the closure is opened.

In recent years, containers of the type generally used for beer and beverages have employed closures, or can ends, having easy opening tabs. In the first generation of such closures, the opening tab was of the type which was severed from the container closure at the time the container was opened. Such removable easy opening tabs presented a problem from the standpoint of litter.

In the second generation easy opening tabs the tab is permanently retained on the can end. In such an end, the pour opening is defined by a score line. Situated adjacent the score line is an opening tab secured to the closure by means of a rivet. The opening tab of this type of closure is adapted to pivot about a fulcrum and to depress the pour opening panel into the container with the opening tab thereafter being retained to the container closure. One such prior art retained tab container closure is set forth and described in U.S. Pat. No. 3,967,752 -Cudzik.

One difficulty encountered in container closures of the type disclosed in the aforementioned Cudzik patent and elsewhere, is that after the opening tab is utilized to sever the pour opening panel from the remainder of the closure at the score line defining the poor opening panel, the retained opening tab remains situated in the vicinity of the pour opening. Since the opening tab is in the vicinity of the pour opening, difficulties are encountered in pouring the contents of the container through the pour opening.

Further, difficulties are encountered when the contents are consumed directly from the container. In this circumstance, the opening tab tends to present an obstacle to the user.

It would be desirable to provide an improved container closure which does not suffer from the aforementioned disadvantages, while retaining the benefits achieved utilizing an opening tab which is retained to the end closure after opening.

Still another problem associated with retained tab type container closures is that these do not lend themselves to various promotional methods now commonly employed. In one promotional method now employed with removeable easy opening tabs, a message or indicia is placed on the inside surface of the tab. The buyer, or consumer, of a particular container removes such easy opening tabs to read the indicia which may indicate a promotional message or the like. With easy opening tabs of the retained type, however, it is impossible to read such promotional messages since, after opening, the pour opening panel is inside the container.

It would be desirable to provide an improved container closure of the retained tab type which lends itself to the utilization of promotional messages on the inside surface of the end closure.

SUMMARY OF THE INVENTION

The present invention solves the aforementioned difficulties by the provision of an end closure of the type having a wall with a pour opening panel defined by a primary score line. The primary score line circumscribes the panel almost in its entirety except at the region of a hinge. An opening tab is attached to the wall adjacent the panel and a rivet type fastening means is utilized to permanently secure the tab to the wall. However, in accordance with the present invention, a pair of secondary score lines are formed in the wall. The secondary score lines are contiguous with the primary score line and project away from it on opposite sides of the aforementioned rivet. The secondary score lines thus define a tab retraction means such that after the pour opening panel is depressed by means of the opening tab, the tab may be retracted from the vicinity of the then exposed pour opening.

In accordance with one embodiment of the present invention, the aforementioned secondary score lines are of lesser depth than the primary score lines, thus ensuring that the pour opening panel is depressed prior to the time that the opening tab is retracted from the vicinity thereof.

BRIEF DESCRIPTION OF THE DRAWING

The present invention will be more fully understood by reference to the accompanying drawings in which.

DETAILED DESCRIPTION OF THE PREFERRED EMBODIMENT

Figure 1:
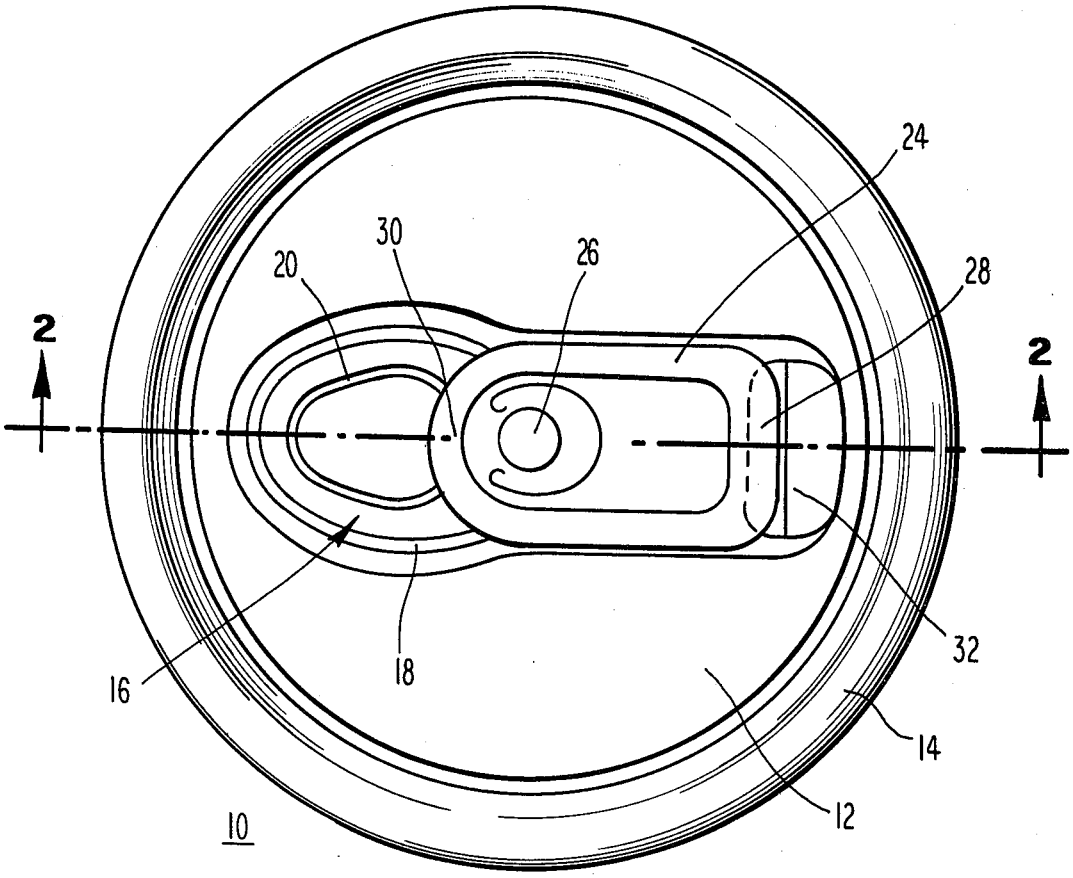
FIG. 1 is a top view of the end closure of the present invention in the closed position.
Figure 2:
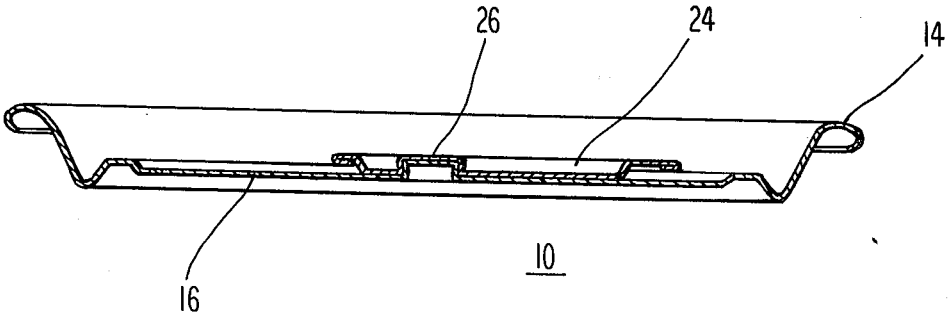
FIG. 2 is a cross-sectional view of the end closure of FIG. 1 taken in the direction of lines 2—2.

Referring now to FIG. 1, an end closure of the present invention is shown generally at 10. The end closure 10 is adapted to be situated at the top of a container (not shown) of the type generally used for containing beer and/or beverages. The end closure 10 comprises a wall 12 having a peripheral edge 14. The peripheral edge 14 of the end closure 10 is suitale for fastening to the aforementioned container by means of a conventional flanging operation. The end closure 10 includes a pour opening panel 16 through which the contents of the container are dispensed when the end closure is opened. The pour opening panel 16 is defined by means of a primary score line 18. More centrally located than the primary score line 18 on the surface of the pour opening panel 16 is a reinforcing ridge 20.

Figure 3:
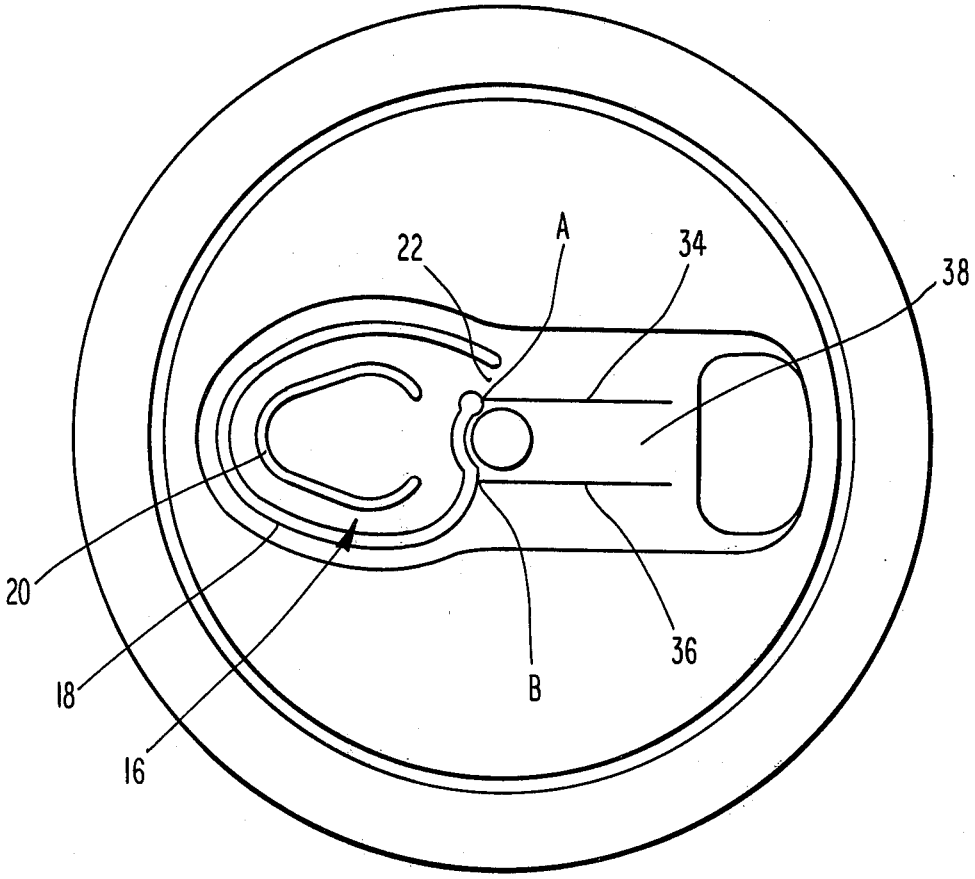
FIG. 3 is a top view of the end closure of FIG. 1, also in the closed position, but with the opening tab thereof removed for the sake of clarity.

As may best seen in FIG. 3, neither the primary score line 18 nor the reinforcing ridge 20 completely define an enclosed region. Thus, the reinforcing ridge 20 is preferably of a U-shape as shown. The primary score line 18, however, completely circumscribes the pour opening panel except at a small hinge region 22.

Referring again to FIG. 1, the closure 10 further comprises an opening tab 24. The opening tab 24 is attached to the wall 12 by a fastening means which preferably comprises a rivet 26 extending through a portion of the opening tab 24. The rivet 26 is preferably a cylindrical hollow rivet defined by the wall 12 and an integral part thereof. The opening tab 24 includes a handle portion 28 and a forward portion 30. The opening tab 24 is adapted to pivot about a fulcrum at rivet 26 such that when the handle portion 28 is lifted, the forward portion 30 is depressed, thereby depressing the pour opening panel 16 into the interior of the container about the hinge region 22 (FIG. 3). To facilitate the lifting of the handle portion 28 with the fingers, the wall 12 preferably includes a depression 32 in the vicinity of the handle portion 28 so as to permit entry of either the fingers or an object thereunder.

Referring again to FIG. 3, and in accordance with an important aspect of the present invention, the wall 12 of the end closure 10 of the present invention includes a pair of secondary score lines 34 and 36. The secondary score line 34 is contiquious with the primary score line 18 at point A. The secondary score line 34 projects away from the pour opening panel 16 and is adjacent to the fulcrum about which the opening tab 24 pivots. The secondary score line is, thus, adjacent to the rivet 26. The other secondary score line 36 is contiquious with the primary score line 18 at point B. The secondary score line 36, like the secondary score line 34, also projects away from the pour opening panel 16 but on the opposite side of the rivet 26. The region 38, which is intermediate to secondary score lines 34 and 36 thus provides a means for retracting the opening tab 16 from the vicinity of the pore opening after the pore opening panel 16 is depressed.

Figure 4:
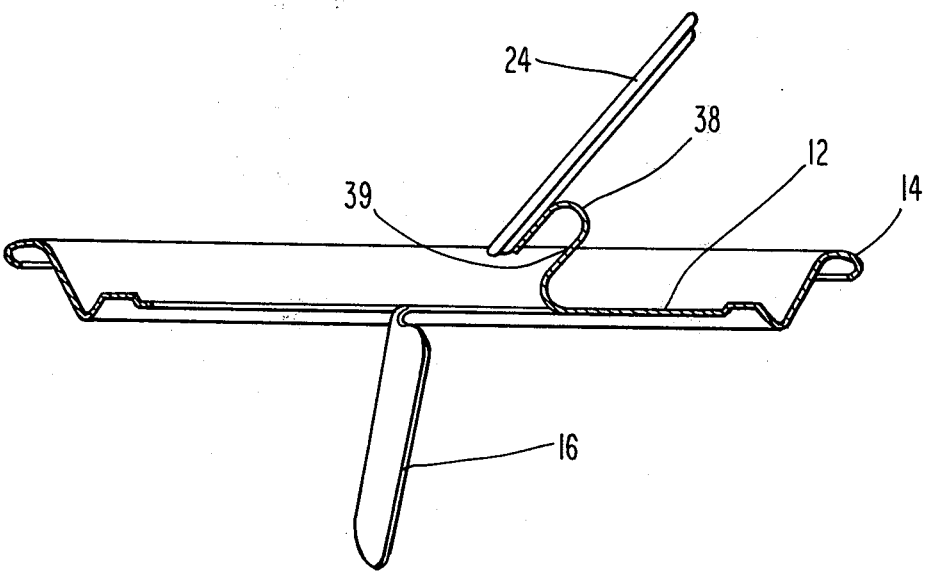
FIG. 4 is a cross-sectional view of the end closure of FIG. 1 similar to that shown in FIG. 2 but with the pour opening panel in an open position and with the opening tab retracted from the vicinity of the pour opening.

As may best be seen in FIG. 4, after the pour opening panel 16 is depressed, the opening tab 24 may be pulled back and away from the pour opening thereby permitting unobstructed egress of the contents of the container. Moreover, the underside 39 of the means 38 for retracting the opening tab 24 may be embossed or printed with promotional indicia which may then be viewed by the consumer after the container is opened.

While the present exemplary embodiments of this invention have been illustrated and described, it will be recognized that this invention may be otherwise variously embodied and practiced within the scope of the following claims.

What is claimed is:

1. In an end closure of the type having a wall with a peripheral edge;

a pour opening panel in said wall, said panel being defined by a primary score line, said primary score line circumscribing said pour opening panel except at a hinge area;

an opening tab attached to said wall at a fulcrum adjacent said primary score line, said opening tab having a handle portion and a forward portion, said forward portion being adapted to depress said pour opening panel to expose a pour opening when said opening tab is pivoted about said fulcrum; and a fastening means at said fulcrum for securing said opening tab to said wall, the improvement comprising:

one secondary score line contiguous with the said primary score line and projecting away from said pour opening panel, said one secondary score line being adjacent to said fulcrum on one side of said fastening means;

another secondary score line contiguous with said primary score line and projecting away from said pour opening panel, said another secondary score line being adjacent said fulcrum on the other side of said fastening means, said one and said another secondary score lines defining a means for retracting said opening tab from said pour opening after said pour opening panel has been depressed.

2. The end closure of claim 1 wherein said secondary score lines are of lesser depth in said wall than said primary score line.

3. The end closure of claim 1 wherein said one and said another secondary score lines are parallel to each other.

4. The end closure of claim 1 wherein said fastening means comprises a rivet extending through a portion of said opening tab.

5. The end closure of claim 4 wherein said rivet comprises a cylindrical hollow rivet defined by said wall as an integral part thereof.

* * * * *